United States Patent [19]

Arndt

[11] 4,049,472

[45] Sept. 20, 1977

[54] ATMOSPHERE COMPOSITIONS AND METHODS OF USING SAME FOR SURFACE TREATING FERROUS METALS

[75] Inventor: Edward J. Arndt, Lenhartsville, Pa.

[73] Assignee: Air Products and Chemicals, Inc., Allentown, Pa.

[21] Appl. No.: 643,348

[22] Filed: Dec. 22, 1975

[51] Int. Cl.[2] ..... C21D 1/48; B23K 35/34; C01B 2/00

[52] U.S. Cl. ..... 148/16; 148/16.5; 148/16.6; 252/372; 148/27

[58] Field of Search ..... 148/165, 30, 16.6, 16, 148/27; 252/372

[56] References Cited

U.S. PATENT DOCUMENTS 3,229,967 1/1966 Engelhard ..... 148/16

3,330,773 7/1967 De Hart ..... 252/372

3,663,315 5/1972 Hoffman et al. ..... 148/16.5

*Primary Examiner*—Walter R. Satterfield

*Attorney, Agent, or Firm*—James C. Simmons; Barry Moyerman

[57] ABSTRACT

Atmosphere compositions and processes utilizing the compositions for heat treating ferrous metal articles under a controlled furnace atmosphere to either maintain or change the surface chemistry of the article being treated are disclosed in the following specification.

The invention features atmosphere compositions or mixtures which are blended from normally gaseous components outside the furnace and the mixture or blend is injected into the furnace to provide a carburizing, decarburizing, carbonitriding or neutral hardening atmosphere inside the furnace.

19 Claims, 7 Drawing Figures

ATMOSPHERE COMPOSITIONS AND METHODS OF USING SAME FOR SURFACE TREATING FERROUS METALS

BACKGROUND OF THE INVENTION

1. Field of the Invention

The invention pertains to the field of metallurgical heat treating, and in particular, to the heat treating of ferrous metal articles under controlled atmospheres. Ferrous metal articles, and in particular, the conventional grades of steel being denoted by grade according to American Iron and Steel Institute (AISI) nomenclature contain carbon. As these articles are raised to elevated temperature for thermal treatment, e.g., hardening, annealing, normalizing and stress relieving, under an ambient furnace atmosphere containing air, hydrogen, water vapor, carbon dioxide, and other chemical compounds the surface of the article will become reactive. It is well known that the presence of water vapor, hydrogen ($H_2$), and carbon dioxide ($CO_2$) in the furnace atmosphere will cause carbon at the surface of the ferrous metal article to react and thus be removed from the article. When the carbon is depleted from the surface of the article, the article no longer has a homogeneous cross section due to the change in chemistry and crystallography thus changing the physical properties such as surface hardness and strength of the finished article. In order to avoid this phenomenon, such articles are heated under a controlled atmosphere containing carbon which is available for reaction with the article being treated, or under an atmosphere that is essentially neutral (to either add a slight amount of carbon to the surface of the ferrous article being heated or prevent removal of carbon from the surface).

Under certain conditions it is desirable to add substantial but controlled amounts of carbon to the surface of the article to increase its surface hardness and wear resistance. This is normally accomplished by heating the article to an elevated temperature in a controlled carbonaceous atmosphere that adds a desired percentage by weight of carbon to the surface of the article. In the same manner, if ammonia is added to the controlled carbonaceous atmosphere, nitrogen as well as carbon is added to the surface of the article to produce additional hardness and wear resistance of the surface of the article.

In certain manufacturing operations, it is desirable to remove controlled amounts of carbon from the surface of the article to achieve a predetermined lower percentage of carbon in the surface of the article. This is accomplished by heating the article to an elevated temperature in a controlled carbonaceous atmosphere that removes carbon from the surface of the article.

In its broad aspect then, the present invention pertains to heating ferrous metal articles under an atmosphere which is created to control the surface chemistry of the article being treated.

2. Description of the Prior Art

The prior art is adequately summarized in the section entitled "Furnace Atmospheres and Carbon Control" found at pages 67 through 92, and that portion of the section entitled "Case Hardening of Steel" appearing at pages 93 through 128 of volume of 2 of the Metals Handbook published in 1964 by the American Society for Metals, Metals Park, Ohio. The particular volume of the Metals Handbook is referred to as Heat Treating, Cleaning and Finishing. All of the material set forth in the aforementioned sections of the Metals Handbook are incorporated herein by reference and will be referred to from time to time in the specification. In particular, that portion of the section on control of surface carbon content appearing on pages 90 through 91 of the Metals Handbook referred to above, and dealing with the determination of carbon potential of a furnace atmosphere is pertinent to the invention herein disclosed.

As set out in the Metals Handbook, furnace atmospheres such as involved in the instant invention, fall broadly into six groups. The first of these is a so called Exothermic Base Atmosphere which is formed by the partial or complete combustion of a fuel gas/air mixture. These mixtures may have the water vapor removed to produce a desired dew point in the atmosphere.

The second broad category is the prepared nitrogen base atmosphere which is an exothermic base with carbon dioxide and water vapor removed.

The third broad classification is Endothermic Base Gas Atmospheres. These are formed by partial reaction of a mixture of fuel gas and air in an externally heated catalyst filled chamber.

The fourth broad category is the charcoal base atmosphere which is formed by passing air through a bed of incandescent charcoal.

The fifth broad category is generally designated as Exothermic-Endothermic Base Atmospheres. These atmospheres are formed by complete combustion of a mixture of fuel gas and air, removing water vapor, and reforming the carbon dioxide to carbon monoxide by means of reaction with fuel gas in an externally heated catalyst filled chamber.

The sixth broad category of prepared atmospheres is the Ammonia Base Atmosphere. This atmosphere can be raw ammonia, dissociated ammonia, or partially or completely combusted dissociated ammonia with a regulated dew point.

In situ generation of carburizing atmosphere in the furnace by decomposition of a hydrocarbon liquid at elevated temperature, is disclosed in U.S. Pat. Nos. 2,056,175. U.S. Pat. No. 2,161,162 discloses in situ creation of a carburizing atmosphere in the furnace and use of the spent furnace atmosphere as a carrier gas. U.S. Pat. No. 3,413,161 discloses creation of a carburizing atmosphere by in situ combustion of a hydrocarbon fuel in the presence of less than stoichiometric amounts of air in the furnace.

Other aspects of carburizing are disclosed in U.S. Pat. Nos. 2,287,651; 2,955,062; 3,356,541 (reissued as U.S. Pat. No. Re. 26,935) and U.S. Pat. No. 3,397,875.

U.S. Pat. No. 2,786,003 discloses a method of nitriding a chromium steel by spiking the furnace atmosphere with carbon monoxide to control the depth of nitriding.

All of the foregoing are representative of the state of the art of protective furnace atmospheres, as well as furnace atmospheres for carburizing, decarburizing, carbonitriding or other carbon control in the surface of a ferrous metal article being heat treated.

SUMMARY OF THE INVENTION

The present invention is drawn to gaseous compositions that are blended at ambient temperature and injected into a metallurgical furnace maintained at an elevated temperature (e.g. in excess of 1500° F), the furnace being used to provide a thermal treatment to a ferrous article while the article is maintained under a protective atmosphere. Specific processes are disclosed as part of the present invention for performing carburizing, decarburizing, carbon restoration, carbonitriding or neutral hardening of a ferrous article by a combination of the thermal history of the article being treated and control of the furnace atmosphere.

Broadly, the preferred atmosphere compositions are a gaseous nitrogen base to which is added natural gas which is substantially methane, carbon dioxide, and in the case of a carbonitriding atmosphere, ammonia. In order to effect the processes, it has been discovered that the ratio of natural gas (methane) to carbon dioxide must be controlled within specified limits. Observing the compositional and ratio limitations specified herein results in the effective processes disclosed and claimed.

In most of the prior art processes that find wide commercial acceptance, the atmospheres are generated externally of the furnace by use of an atmosphere generator wherein air and fuel gas are combusted to form an atmosphere or carrier gas which is then injected into the heat treating furnace. Most of the exothermic and endothermic atmospheres require auxiliary generators thus requiring a substantial capital expenditure for such equipment. One of the keys to the present invention is the simple blending of the gaseous components outside the furnace which are then injected into the furnace for reaction to achieve the desired process thus eliminating the need for an auxiliary generator.

Therefore, it is the primary object of this invention to provide improved atmosphere compositions for injecting into metallurgical treatment furnaces.

It is another object of this invention to provide an atmosphere composition and process for carburizing ferrous metal articles.

It is yet another object of the present invention to provide an atmosphere composition and process for decarburizing ferrous metal articles.

It is a further object of the present invention to provide atmosphere compositions and processes for carbonitriding ferrous metal articles.

It is still another object of the present invention to provide atmosphere compositions and processes for neutral hardening ferrous metal articles.

Another object of the present invention is to provide processes for carbon restoration on the surface of decarburized ferrous metal articles using the atmosphere compositions of the present invention.

DETAILED DESCRIPTION OF THE INVENTION

Figure 3:
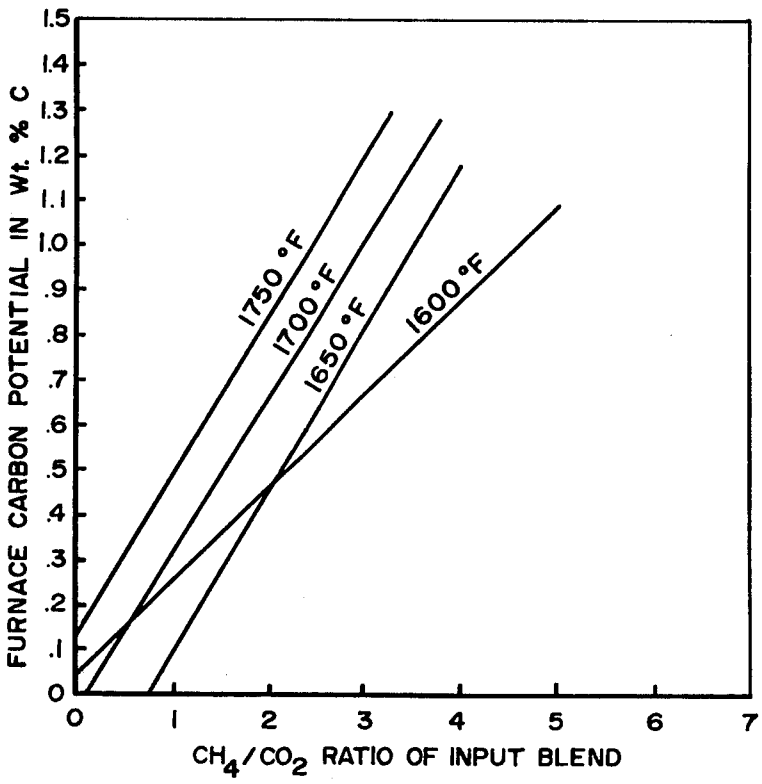
FIG. 3 is a plot of carbon potential against natural gas/carbon dioxide ratio for carburizing compositions of the present invention injected into a metallurgical furnace maintained at 1600°, 1650°, 1700° and 1750° F.

Furnace Atmosphere compositions suitable for use during heat treating of ferrous articles can be accomplished by blending individual gases outside of the furnace and then injecting these gases into the furnace for either protecting the surface of the ferrous articles, depleting carbon from the surface of the ferrous articles, adding carbon to the surface of the ferrous articles or carbonitriding the surface of the ferrous articles in the furnace. These atmospheres can be varied during injection into the furnace to provide controlled variation of surface chemistry of the articles being treated and the parts can be removed from the furnace and cooled in a conventional manner such as air cooling, oil quenching, water quenching and the like.

The atmosphere composition is blended from a source of commercially available nitrogen, a source of natural gas which is predominantly methane and which is commonly found in industrial plants as a pipeline natural gas, commercially available carbon dioxide and in the case of carbonitriding, ammonia. These gases can be metered into the furnace directly through a blending panel thus eliminating the endothermic generator which is normally required for producing carburizing atmosphere gases.

The atmospheres, according to the present invention, have two properties heretofore not available with conventional atmospheres generated either using exothermic, endothermic or other conventional techniques. These are:

1. Carbon potential of the furnace atmosphere bears a direct relationship to the methane to carbon dioxide ratio of the input blend. The input ratio relationship has been established at temperatures ranging from 1600° to 1750° F as will be disclosed hereinafter.
2. Carbon availability of the blend can be varied by adjusting the percentage of nitrogen as well as the methane/carbon dioxide ratio. Carbon availability can be increased by decreasing the percentage of nitrogen and increasing the methane/carbon dioxide ($CH_4/CO_2$) ratio and vice versa. This will also be adequately demonstrated hereinafter.

The compositions of the present invention can be broadly summarized as follows:

| COMPONENT | VOLUME PERCENT |
|---|---|
| Nitrogen | 62–98 |
| Natural Gas ($CH_4$) | 1.5–27 |
| Carbon Dioxide | 0.2–15 |
| Ammonia | 0.0–10 |
| $CH_4/CO_2$ | 0.5–15 |

Within the broad ranges set out above, the invention contemplates using compositions that are suitable for performing carburizing (including carbon restoration), decarburizing, neutral hardening and carbonitriding of ferrous metal articles by elevated temperature thermal treatment. Set forth in Table I below is a summary of broad process data according to the present invention.

Within the above broad compositional ranges, further control can be achieved by balancing the methane plus carbon dioxide so that; in the case of carburizing, the methane plus carbon dioxide is between 9.5 and 20% by volume; in the case of decarburizing, it is between 10 and 18% by volume, in the case of neutral hardening, it is between 2 and 9% by volume; and, in the case of carbonitriding, it is between 9.6 and 30.0% by volume of the total gas mixture.

In the context of the present invention, carburizing is taken to mean that process wherein carbon is added to the surface of a ferrous metal article in order to increase the carbon content at the surface thus producing a case of higher carbon, or to restore carbon to the surface of the article so that the carbon content is homogeneous throughout the cross section of the ferrous metal article. In carbon restoration, what is sought is to replace the carbon that may have been depleted in previous heating operations which were not conducted under atmosphere control.

TABLE I

| PROCESS | ATMOSPHERE COMPOSITION % BY VOLUME | | | | | FURNACE TEMPERATURE |
|---|---|---|---|---|---|---|
| | $N_2$ | $CH_4$ | $CO_2$ | $CH_4CO_2$ | $NH_3$ | |
| Carburizing | 78.0-92.0 | 6.5-17.0 | 1.4-14.0 | 1.4 - 8.0 | — | 1600° F - 1750° F |
| Decarburizing | 82.0-90.0 | 3.3-15.0 | 1.7-12.0 | 0.5 - 5.00 | — | 1600° F - 1750° F |
| Neutral Hardening | 91.0-98.0 | 1.5-7.5 | 0.2-2.0 | 0.5 - 9.0 | — | 1500° F - 1650° F |
| Carbonitriding | 62.2-90.0 | 6.0-27.2 | 1.0-3.5 | 3.0 - 13.5 | 1.5 - 10.0 | 1550° F - 1650° F |

Conventional carburizing techniques are well known as amply discussed in the prior art set out above.

Decarburizing is taken to mean that process of removing carbon from the surface of a ferrous metal article or from the entire cross section of a ferrous metal article, if the section permits, for the purposes of subsequent treatment, fabrication or use in other manufacturing processes.

Neutral hardening is taken to mean that process under which ferrous metal articles are heated to an elevated temperature for cooling to produce a hardened structure in the cross section. The atmosphere is selected so that carbon is neither added nor depleted from the surface of the article except that in some instances, slight decarburization (e.g. one or two thousandths of an inch) is acceptable.

Carbonitriding is taken to mean that process wherein nitrogen, as well as carbon, is transferred from the atmosphere into the surface of the ferrous metal article.

Blends, according to the present invention, were achieved utilizing bulk nitrogen, which is commercially available and which can be provided from a tank truck in liquid form and vaporized to a gas, standard gas cylinders either portable or in the form of tube trailers, and by nitrogen generating plants which produce nitrogen by liquefaction and fractionation of air; natural gas which is predominantly methane, commercially available carbon dioxide which can be obtained in bulk (liquid or gas) or cylinder form; and gaseous ammonia, also commercially available in a variety of known containers. The gaseous ingredients for the blend were piped from the storage recepticles to a multi-component gas blender designed by Air Products and Chemicals, Inc. to blend the gases used for the tests hereinafter described. Conventional blenders for combining gaseous components that are unreactive at ambient temperature can be used as is well known in the gas blending art.

The gaseous blends were injected into a production furnace according to techniques dictated by the particular furnace and the heat treating process being employed. Injecting of atmospheres into either batch or continuous furnaces is well known in the art and will vary depending on the size of the furnace and the particular heat treating process being employed.

Of particular interest, is the gas carburizing process developed as part of the instant invention.

Figure 1:
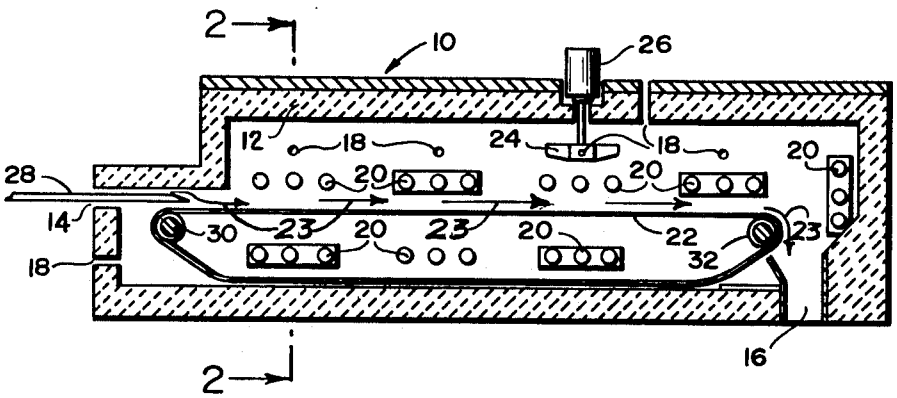
FIG. 1 is a longitudinal section of a continuous heat treating furnace suitable for use with the compositions of the present invention and practicing the methods of the present invention.
Figure 2:
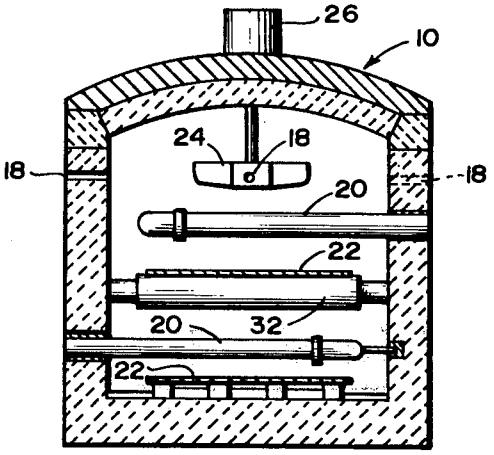
FIG. 2 is a section taken along line 2—2 of FIG. 1.

One furnace utilized in running carburizing trials is illustrated in FIGS. 1 and 2. In FIG. 1 the furnace, shown generally as 10, includes a furnace shell 12 having an entry opening 14 and a discharge opening 16. The shell has numerous atmosphere ports 18 through which the atmosphere is introduced into and maintained in the furnace. The furnace 10 includes a plurality of heating tubes 20 located both above and below a continuous belt 22 upon which the articles to be heat treated are placed for entry into the furnace in accordance with the work flow shown by arrows 23 in FIG. 1. The furnace includes a fan blade 24 which is driven by fan motor 26 to circulate the atmosphere within the furnace and to help equalize the furnace for uniform heat treatment of the parts moving along belt 22. In the normal scheme of things, product is introduced by a vibratory feeder 28 onto the belt 22 through entry 14 of furnace 10. The belt moves in the direction shown carrying the articles into the furnace where they are exposed both to the temperature resulting from heaters 20 and the atmosphere introduced through ports 18. The speed of the belt 22 is adjusted so that the articles being treated are not only brought to temperature of the furnace, but maintained at temperature for a sufficient period of time to achieve the desired thermal treatment. Belt 22 is driven over rollers 30 and 32 by a motor or other device (not shown) generally outside the furnace. Roller 32 generally defines the discharge end of the belt where the parts fall through exit 16 and can be collected for cooling in ambient atmosphere or can be directly conducted into a tank containing quenching oil or other liquefied quenching media as is well known in the art.

In accomplishing carburizing of ferrous metal articles, a furnace such as shown in FIG. 1 is generally maintained at temperatures ranging from 1600° to 1750° F. The carburizing potential of the atmosphere can be determined by the shim stock method as set out in the Metals Handbook, volume 2 at pages 90 and 91. In this method, thin metal samples of the same grade of metal that is being carburized are put into the furnace with the parts being carburized. The thickness of the sample is selected so that for the residence time in the furnace, the article will be carburized throughout its cross section. The samples are carefully weighed before and after the carburizing treatment and the carbon potential is determined by the numerical addition of the percent weight gain in the shim stock and the original weight percent carbon in the sample. This method is well known and widely accepted as an indicator of the ability of a given furnace atmosphere to carburize metal parts to the desired case depth and carbon level. In the present invention, carburizing was accomplished with total gas mixture flow rates ranging from 530 to 1074 standard cubic feet per hour (SCFH) in a batch furnace and 1200 to 2000 SCFH in a continuous furnace wherein the mixture was predominantly nitrogen (78–92% by volume) with the remainder natural gas (methane) and carbon dioxide.

In using the continuous furnace shown in FIGS. 1 and 2, the atmosphere was introduced into the furnace through the ports 18 and allowed to leave the furnace through entry port 14 and exit port 16. The exit chute 16 was fitted with an adjustable gas ejector to continuously draw atmosphere from the furnace down through the chute and out an exhaust stack to prevent air from entering the furnace at this point. A standard flame curtain, as is well known in the art, was employed at the entrance to the furnace. The type of furnace used in running the tests as will be detailed hereafter is generally referred to as a single zone natural gas fired radiant tube design, and has a rated capacity of 2,000 pounds per hour. This furnace normally runs with an endothermic atmosphere having a flow rate of 2100 SCFH in addition to 200 SCF of natural gas to obtain desired carbon potential.

In utilizing a continuous furnace with the nitrogen based carburizing atmospheres according to the invention, several techniques had to be adhered to as follows:

1. Atmosphere flow through the furnace must be predominantly concurrent with the work flow to allow the bulk of the atmosphere input to heat up along with the work and to obtain full benefit of methane and carbon dioxide additions. Thus, at the low temperature at the charge end of the furnace, the gases do not fully react, thus moving the unreactive gases into progressively hotter zones thus promoting complete reaction and utilization of the gases introduced into the furnace.
2. Most of the nitrogen used in the blend must be added close to the charge end of the furnace to prevent air infiltration at that point, and as a carrier for the natural gas and carbon dioxide throughout the length of the furnace.
3. The methane/carbon dioxide ratio at the entrance end of the furnace must be high in order to establish a carbon potential at the lower temperature of the charge.
4. Methane and carbon dioxide additions must be made along the entire length of the furnace in order to (a) replenish the gases consumed initially in the carburizing reactions, (b) to establish the desired carbon potential profile, and (c) to promote circulation, if necessary, in the furnace.

The foregoing conditions must be observed when using the atmosphere compositions of the present invention for carburizing and carbonitriding in a continuous furnace. However, such control is not as critical in neutral hardening operations performed in a continuous furnace.

The carburizing blends were tried in batch carburizing furnaces at temperatures between 1700° and 1750° F. For a batch type furnace the following process steps were determined to yield the best results:

1. Purge the furnace with nitrogen and charge the parts to be carburized into the furnace.
2. Heat furnace and equalize the load with a furnace atmosphere containing approximately 80% nitrogen and having a $CH_4/CO_2$ ratio of approximately 8 to 1 at 1700° F.
3. Continue the same atmosphere composition containing approximately 80% nitrogen while adjusting the $CH_4/CO_2$ ratio to establish a carbon potential equivalent to or near the equal of carbon in saturated austenite at the carburizing temperature for the material being treated.
4. Near the end of the caburizing cycle reduce the $CH_4/CO_2$ ratio to achieve a carbon potential equivalent to the desired final carbon level at the surface of the part being treated.
5. At the beginning of furnace cooling of the load to the quench temperature increase the level of nitrogen to approximately 95% while holding the same or a slightly higher $CH_4/CO_2$ ratio.
6. When the load is stabilized at quench temperature, oil quench.

The foregoing practice of course can be varied depending upon the nature of the furnace and the desired finished carbon at the surface of the article being treated.

Set forth in the following tables (II–V) are the results of tests run in production furnaces using a nitrogen($N_2$)-methane ($CH_4$)-carbon dioxide ($CO_2$) gas blend to achieve a carburized case on a finished metal article. The data reported in Tables II–V is based upon through carburizing of AISI 1008 steel sheet (shim stock) 0.004 inch thick in with the method for measuring carbon potential of a furnace atmosphere as specified in the Metals Handbook section referred to above.

TABLE II $N_2$—$CH_4$—$CO_2$ CARBURIZING TRIALS AT 1600° F; CARBON POTENTIAL-INPUT GAS BLEND AND FURNACE DATA

GAS INPUT DATA - Composition % by Volume

| Test Code | $N_2$ | $CH_4$ | $CO_2$ | Total Gas Flow | Input $CH_4/CO_2$ | Furnace Carbon Potential in % C |
|---|---|---|---|---|---|---|
| 1. | 80.00% | 12.00% | 8.00% | 600CFH | 1.50 | .33% |
| 2. | 85.00% | 10.00% | 5.00% | 600CFH | 2.00 | .43% |
| 3. | 90.00% | 7.17% | 2.83% | 600CFH | 2.53 | .37% |
| 4. | 85.00% | 11.25% | 3.75% | 600CFH | 3.00 | .71% |
| 5. | 80.00% | 15.50% | 4.50% | 600CFH | 3.44 | .78% |
| 6. | 86.75% | 10.36% | 2.89% | 622.5CFH | 3.58 | .75% |
| 7. | 85.00% | 12.00% | 3.00% | 600CFH | 4.00 | .86% |
| 8. | 90.00% | 8.00% | 2.00% | 600CFH | 4.00 | .80% |
| 9. | 80.00% | 16.67% | 3.33% | 600CFH | 5.00 | 1.09% |
| 10. | 85.00% | 12.50% | 2.50% | 600CFH | 5.00 | 1.03% |

TABLE III $N_2$—$CH_4$—$CO_2$ CARBURIZING TRIALS AT 1650° F; CARBON POTENTIAL-INPUT GAS BLEND AND FURNACE DATA

GAS INPUT DATA - Composition % by Volume

| Test Code | $N_2$ | $CH_4$ | $CO_2$ | Total Gas Flow | Input $CH_4/CO_2$ | Furnace Carbon Potential in % C |
|---|---|---|---|---|---|---|
| 1. | 80.00% | 11.17% | 8.83% | 600CFH | 1.26 | .16% |
| 2. | 80.00% | 12.50% | 7.50% | 600CFH | 1.67 | .40% |
| 3. | 90.00% | 6.67% | 3.33% | 600CFH | 2.00 | .43% |
| 4. | 85.00% | 10.67% | 4.33% | 600CFH | 2.46 | .61% |
| 5. | 80.00% | 14.75% | 5.25% | 600CFH | 2.81 | .83% |
| 6. | 90.00% | 7.50% | 2.50% | 600CFH | 3.00 | .76% |
| 7. | 80.00% | 15.5% | 4.50% | 600CFH | 3.44 | 1.08% |
| 8. | 85.00% | 13.72% | 3.33% | 600CFH | 3.50 | .90% |
| 9. | 85.00% | 12.17% | 2.83% | 600CFH | 4.29 | 1.10% |
| 10. | 80.00% | 16.33% | 3.67% | 600CFH | 4.46 | 1.16% |
| 11. | 80.00% | 16.67% | 3.33% | 600CFH | 5.00 | 1.00% |
| 12. | 85.00% | 12.50% | 2.50% | 600CFH | 5.00 | 1.11% |
| 13. | 90.00% | 8.33% | 1.67% | 600CFH | 5.00 | .91% |

TABLE IV $N_2$—$CH_4$—$CO_2$ CARBURIZING TRIALS AT 1700° F; CARBON POTENTIAL-INPUT GAS BLEND AND FURNACE DATA

GAS INPUT DATA - Composition % by Volume

| Test Code | $N_2$ | $CH_4$ | $CO_2$ | Total Gas Flow | input $CH_4CO_2$ | Furnace Carbon Potential in % C |
|---|---|---|---|---|---|---|
| 1. | 84.74% | 8.47% | 6.78% | 590CFH | 1.25 | .37% |
| 2. | 86.96% | 8.70% | 4.35% | 575CFH | 2.00 | .66% |
| 3. | 88.03% | 8.80% | 3.17% | 568CFH | 2.78 | .92% |
| 4. | 81.94% | 13.97% | 4.09% | 537CFH | 3.41 | 1.17% |
| 5. | 81.94% | 13.97% | 4.09% | 1074CFH | 3.41 | 1.07% |
| 6. | 79.17% | 13.77% | 3.61% | 561CFH | 3.81 | 1.22% |
| 7. | 88.89% | 8.89% | 2.22 | 562.5CFH | 4.00 | 1.09% |
| 8. | 81.78% | 15.06% | 3.16% | 538CFH | 4.76 | 1.30% |
| 9. | 86.38% | 11.27% | 2.35% | 532.5CFH | 4.80 | 1.17% |
| 10. | 83.64% | 13.64% | 2.73% | 550CFH | 5.00 | 1.32% |
| 11. | 84.83% | 12.63% | 2.53% | 542CFH | 5.00 | 1.16% |
| 12. | 83.72% | 13.56% | 2.71% | 597.2CFH | 5.00 | 1.17% |
| 13. | 89.29% | 8.93% | 1.79% | 560CFH | 5.00 | 1.08% |
| 14. | 89.29% | 8.93% | 1.79% | 560CFH | 5.00 | 1.10% |
| 15. | 86.79% | 11.32% | 1.89% | 530CFH | 6.00 | 1.12% |
| 16. | 89.60% | 8.96% | 1.43% | 558CFH | 6.25 | 1.06 |

TABLE V $N_2$—$CH_4$—$CO_2$ CARBURIZING TRIALS AT 1750° F; CARBON POTENTIAL-INPUT GAS BLEND AND FURNACE DATA

GAS INPUT DATA - Composition % by Volume

| Test Code | $N_2$ | $CH_4$ | $CO_2$ | Total Gas Flow | Input $CH_4/CO_2$ | Furnace Carbon Potential in % C |
|---|---|---|---|---|---|---|
| 1. | 80.00% | 6.67% | 13.33% | 600CFH | .50 | .32% |
| 2. | 85.00% | 12.50% | 12.50% | 600CFH | 1.00 | .38% |
| 3. | 80.00% | 12.00% | 8.00% | 600CFH | 1.50 | .68% |
| 4. | 85.00% | 10.00% | 5.00% | 600CFH | 2.00 | .68% |
| 5. | 85.00% | 10.00% | 5.00% | 600CFH | 2.00 | .93% |
| 6. | 90.00% | 6.67% | 3.33% | 600CFH | 2.00 | .58% |
| 7. | 90.00% | 6.67% | 3.33% | 600CFH | 2.00 | .90% |
| 8. | 85.00% | 10.67% | 4.33% | 600CFH | 2.46 | 1.03% |
| 9. | 80.00% | 12.00% | 8.00% | 600CFH | 3.00 | 1.21% |
| 10. | 80.00% | 15.50% | 4.50% | 600CFH | 3.44 | 1.27% |
| 11. | 85.00% | 11.67% | 3.33% | 600CFH | 3.50 | 1.11% |
| 12. | 90.00% | 7.67% | 2.17% | 600CFH | 3.54 | 1.12% |
| 13. | 80.00% | 16.00% | 4.00% | 600CFH | 4.00 | 1.37% |
| 14. | 90.00% | 8.00% | 2.00% | 600CFH | 4.00 | 1.17% |
| 15. | 85.00% | 12.50% | 2.50% | 600CFH | 5.00 | 1.50% |

From the foregoing tables it is readily apparent that an atmosphere suitable for carburizing ferrous metal parts can be achieved by blending a mixture containing 78 to 92% by volume nitrogen, 6.5 to 17.0% by volume natural gas (methane) and 1.4 to 14% by volume carbon dioxide. Furthermore an effective carburizing process is achieved when the ratio of methane/carbon dioxide of the mixture is held between 1.4 and 8.0. Furthermore, when the mixture contains methane plus carbon dioxide in a range of between 9.5 and 20% by volume of the total mixture there are further refinements and benefits to be obtained in the process.

Figure 5:
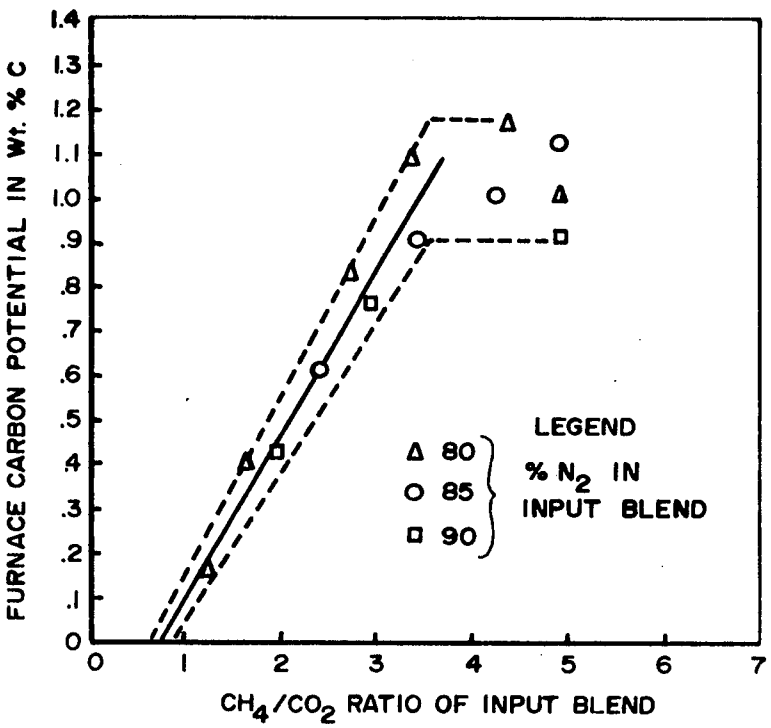
FIG. 5 is a plot of carbon potential against methane/carbon dioxide ratio for carburizing compositions of the present invention injected into a furnace at 1650° F.
Figure 4:
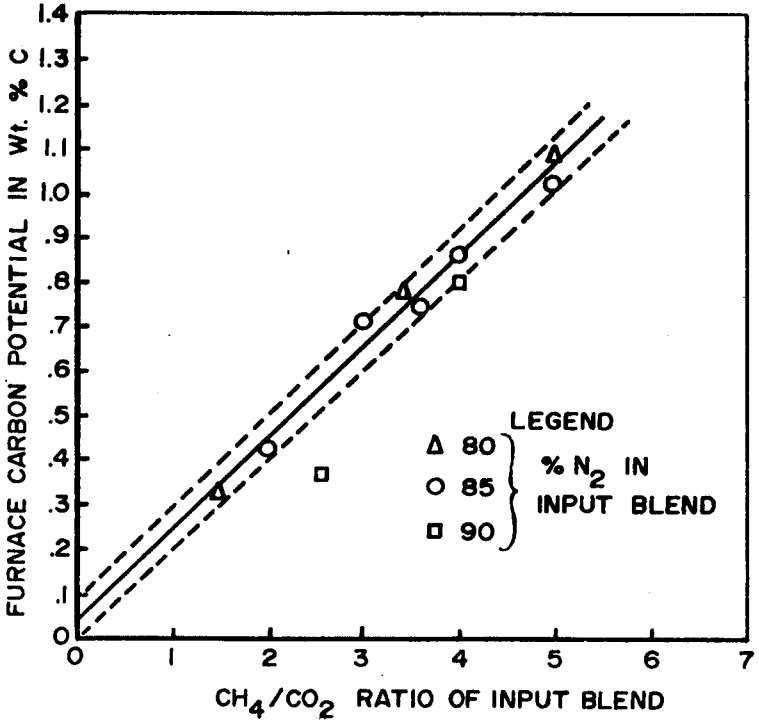
FIG. 4 is a plot of carbon potential against natural gas/carbon dioxide ratio for carburizing compositions according to the present invention in a furnace operated at 1600° F.
Figure 7:
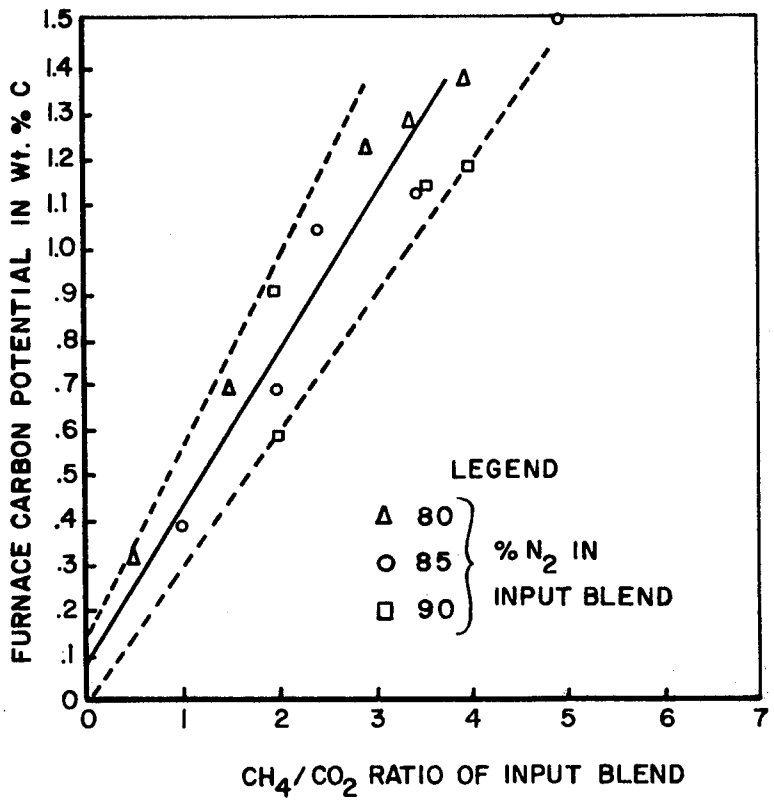
FIG. 7 is a plot of carbon potential against methane/carbon dioxide ratio for carburizing compositions of the present invention injected into a furnace at 1750° F.
Figure 6:
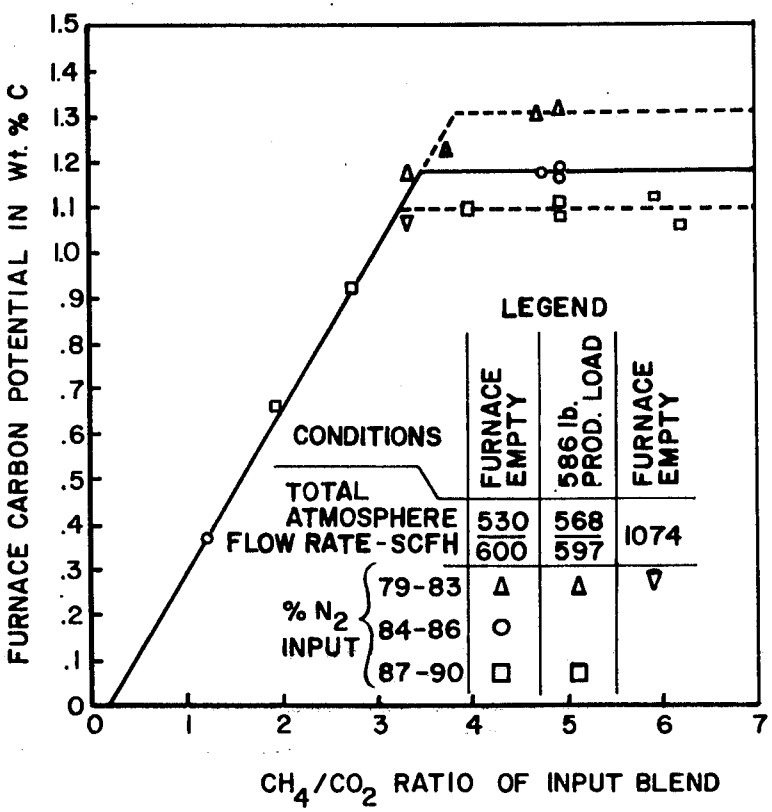
FIG. 6 is a plot of carbon potential against natural gas/carbon dioxide ratio for carburizing compositions of the present invention injected into a furnace at 1700° F.

The effect of control of the methane/carbon dioxide ($CH_4/CO_2$) ratio on carbon potential of the furnace is graphically illustrated in FIG. 3. FIG. 3 is a plot of carbon potential against $CH_4/CO_2$ ratio for a nitrogen-methane-carbon dioxide blend containing between 79 and 90% nitrogen for furnace operating temperatures of 1600°, 1650°, 1700° and 1750° F. FIG. 4 illustrates the effect of the methane/carbon dioxide ratio on carbon potential for a furnace operated at 1600° F wherein the input blend had 80, 85, and 90% nitrogen as shown. FIG. 5 is a plot of carbon potential against methane/-carbon dioxide ratio similar to that of FIG. 4 with the furnace temperature at 1650° F. FIG. 6 is a plot of carbon potential against methane/carbon dioxide ratio for nitrogen-methane-carbon dioxide blends wherein the furnace temperature is maintained at 1700° F and the nitrogen input is as shown on the graph. Lastly, FIG. 7 is a plot of carbon potential against methane/carbon dioxide ratio for varying nitrogen contents in a nitrogen-methane-carbon dioxide input blend wherein the furnace is maintained at 1750° F. The foregoing curves can be used to accurately predict the carbon potential of a furnace operating with blends according to the present invention at the temperature indicated.

Production decarburizing trials were also conducted in accord with the present invention with the results set forth in Table VI below. In carburizing, the amount of carbon in the surface of ferrous articles can be increased by exposing the articles to the nitrogen-methane-carbon dioxide gas blend injected into a furnace at elevated temperatures. This is accomplished by establishing a carbon potential in the furnace at a level higher than that present initially in the ferrous articles by adjusting the ratio of methane to carbon dioxide in accordance with FIGS. 3 through 7.

It is well known in the art that carburizing is a reversible process. Articles can be decarburized by use of the atmosphere created from the nitrogen-methane-carbon dioxide blend injected into a heat treating furnace at elevated temperatures by adjusting the methane to carbon dioxide ratio so the carbon potential of the furnace atmosphere is lower than the amount of carbon in the surface of the article as determined by using the curves of FIGS. 3 through 7.

Controlled decarburizing of ferrous articles was performed in the nitrogen-methane-carbon dioxide blends as set out in Table VI. The articles were accidently over carburized by processing in endothermic gas. This over carburizing of the articles fabricated from AISI 8620 steel resulted in an excessive and undesirable amount of retained austenite in the carburized case of the parts after quenching. It is well known that 8620 steel has been over carburized when retained austenite in excess of 5% by volume is present in the carburized case. The articles were salvaged by a controlled decarburizing process applied in a furnace at elevated temperature using nitrogen-methane-carbon dioxide input blends according to the present invention. The ratio of methane to carbon dioxide was chosen to from FIG. 6 to reduce tha mount of surface carbon to acceptable levels so that the undesirable retention of austenite upon quenching was avoided, as set forth in the results appearing in Table VI.

TABLE VI

Part Description and Specifications: Piston Pins - AISI 8620 steel

Prior Heat Treatment: Nine loads of pins overly carburized in endothermic gas during 12 hour cycle. Lab tests indicated 8 to 15% retained austenite in case to depth of .025" as cause for rejection.

Salvage Treatment: Perform controlled decarburization of surface to minimize (spec. less than 5%) retained austenite upon quenching while maintaining case hardness after quench of Rockwell C 50 minimum.

All loads processed at 1700° F and oil quenched.

Heats 1 & 2: 4 hrs at 1700° F, Atmosphere % by volume 83.$N_2$, 11.7 $CH_4$, 5.3 $CO_2$ Heats 3 to 9: 3 " % by volume 90.0 $N_2$, 6.8 $CH_4$, 3.2 $CO_2$ TABLE VI-continued Laboratory Test Results:

a. Metallographic
Total case, all heats = .105" - 112", retained austenite less than 5% all heats b. Microhardness

| Depth Below Surface (inches) | Rockwell "C" Hardness HT 1 | HT 2 | HT 3 | HT 4 | HT 5 | HT 6 | HT 7 | HT 8 | HT 9 | Remarks |
|---|---|---|---|---|---|---|---|---|---|---|
| .006" | 57 | 57 | 58 | 57 | 57 | 57 | 57 | 56 | 57 | |
| .010" | 57 | 57 | 58 | 57 | 57 | 57 | 57 | 57 | 57 | |
| .020" | 57 | 57 | 57 | 57 | 57 | 57 | 57 | 57 | 57 | |
| .030" | 56 | 56 | 56 | 57 | 56 | 57 | 56 | 57 | 56 | |
| .040" | 55 | 55 | 54 | 55 | 55 | 54 | 55 | 56 | 55 | |
| .050" | 53 | 54 | 53 | 53 | 52 | 53 | 52 | 52 | 53 | |
| .060" | 51 | 49 | 52 | 51 | 52 | 51 | 50 | 49 | 51 | |
| .080" | | | | | | | | | | |
| .200" | 39 | 43 | 41 | 31 | 32 | 29 | 34 | 31 | 29 | Core hardness |

In order to perform neutral hardening the amount of carbon in the surface of the ferrous article should be maintained at its initial level during heat treatment, that is, the amount of carbon is neither increased nor depleted from the surface of the article, after exposure of the article to the nitrogen-methane-carbon dioxide blends in a furnace at elevated temperatures. This is accomplished by establishing a carbon potential into the furnace equal to, or slightly higher than the amount of carbon in the articles. This is performed by adjusting the carbon potential of the atmosphere in accordance with FIGS. 3 through 7.

Production neutral hardening trials were conducted in accord with the present invention and the results set forth on Table VII below. The production neutral hardening trials were conducted at 1550° F with the nitrogen-methane-carbon dioxide blends. In all cases a slight but acceptable degree of decarburization was observed on all samples, however, this did not affect the finished parts as they were within specified tolerance for hardness and decarburization.

TABLE VII

NEUTRAL HARDENING

| Test | Input Blend (Vol %) $N_2$ | $CH_4$ | $CO_2$ | $NH_3$ | Input $CH_4/CO_2$ | Thermal Treatment | Hardness(Rockwell) (As Quenched) Surface | Core | Material Treated |
|---|---|---|---|---|---|---|---|---|---|
| 1. | 95.0 | 3.1 | 1.9 | — | 1.7 | Heat 1550° F - Oil Quench - Temper | 86(15N) ($R_c$ 52) | $R_c$ 52-53 | 3/4" D U Bolts AISI 5140 Steel |
| 2. | 95.0 | 4.3 | 0.7 | — | 6.0 | Heat 1550° F - Oil Quench - Temper | 84(15N) | 88(15N) | 3/4" D U Bolts AISI 5140 Steel |
| 3. | 98.0 | 1.8 | 0.2 | — | 9.0 | Heat 1550° F - Oil Quench - Temper | 82(15N) | 88(15N) | 3/4" D U Bolts AISI 5140 Steel |
| 4. | 94.4 | 5.0 | 0.6 | — | 9.0* | Heat 1550° F - Oil Quench - Temper | 50 ($R_c$) | 53 ($R_c$) | 3/8" Dia. × 4" Long Valve Stems AISI 4140 Steel |
| 5. | 97.0 | 2.6 | 0.4 | — | 6.5 | Heat 1550° F - Oil Quench - Temper | 46 ($R_c$) | 48 | 5/16" Dia. × 1" Long Bolts AISI 4140 Steel |
| 6. | 91.2 | 7.5 | 1.2 | — | 6.2 | Heat 1550° F - Oil Quench - Temper | 40 ($R_c$) | 43 ($R_c$) | 1/4" Dia. × 1-1/2" Screws AISI 4037 Steel |

*Ave.
Note:
Tests 1-3 were run in a batch furnace;
Tests 4-5 were run in a continuous furnace.

It is apparent from the foregoing table that for neutral hardening ferrous metal articles a temperature of approximately 1550° F is suitable although this temperature can be varied from 1500° to 1650° F. Over this temperature range the atmosphere can contain between 91 and 98% by volume nitrogen, 1.5 to 7.5% by volume methane, and 0.2 to 2.0% by volume carbon dioxide. The methane/carbon dioxide ratio of the mixture should be between 1.7 and 9.0 in order to achieve the neutral hardening. Furthermore, if the methane plus carbon dioxide is held between 2.0 and 9.0% by volume of the total mixture, the atmosphere achieves superior results. It has been discovered that control of carbon potential below 1600° F may not be consistent, however, it is evident that neutral hardening can be performed below 1600° F by using a high nitrogen content with a moderate to high $CH_4/CO_2$ ratio. It is believed that under these operating conditions an atmosphere that is high in carbon potential is in a "starvation condition," i.e., that atmosphere has only limited capability for carbon transfer. Thus the carbon level in the surface in the article being heated would be maintained as the work reaches to soak temperature. During the heating up period however, the atmosphere may be slightly decarburizing. In order to counteract this phenomena the atmosphere can consist of essentially nitrogen and natural gas (methane) during the heating cycle and then as the part being treated is soaked at temperature carbon dioxide can be added to achieve the desired carbon potential by control of the methane/carbon dioxide ratio.

Carbonitriding is generally used to produce cases which are harder than those produced by straight carburizing of the ferrous metal article. These cases are usually specified for cases having shallower depths thus carbonitriding process times are measured in minutes rather than in hours as common with carburizing.

A series of carbonitriding trials were performed at temperatures of 1550°, 1600°, 1650° F with ammonia ($NH_3$) added to the nitrogen-methane-carbon dioxide blend which is introduced when the parts reach the desired furnace holding (soak) temperature.

Pure nitrogen is injected into the furnace during the "heating-up" phase of the heating cycle, in order to improve control of case depth uniformity throughout the furnace load. Normally when using endothermic gas processing, some carburizing or carbonitriding takes place while the parts are in the furnace being brought to the furnace temperature. This can lead to non-uniformity of case depth since the parts closer to the furnace heating tubes are brought to temperature at a faster rate than the parts at the middle of the furnace load. Using inert nitrogen for heatup eliminates this major cause of case depth variation. In terms of operating practice, closer case depth tolerances and higher carbonitriding temperatures may be possible using atmosphere compositions and methods according to the present invention.

The results of batch carbonitriding tests are set out in Table VIII; and a series of continous carbonitriding tests are detailed in Table IX.

TABLE VIII

BATCH CARBONITRIDING

| Test | Input Blend (Vol. %) $N_2$ | $CH_4$ | $CO_2$ | $NH_3$ | Input $CH_4/CO_2$ | Thermal Treatment | Micro-Hardness (As Quenched) Surface | Core | Material Treated |
|---|---|---|---|---|---|---|---|---|---|
| 1. | a) 100 | — | — | — | — | a) Heat to 1550° F | | | AISI 1010 Steel |
| | b) 87.5 | 7.2 | 2.4 | 2.9 | 3.00 | b) Heat 1550° F 30 min. and oil quench | 58($R_c$) | 40($R_c$) | Shock Absorber Bushings |
| 2. | a) 100 | — | — | — | — | a) Heat to 1600° F | | | AISI 12L14 |
| | b) 76.8 | 14.3 | 3.1 | 5.8 | 4.50 | b) Heat 12 min. at 1600° F | 61 ($R_c$) | 41 ($R_c$) | Steel |
| | c) 88.0 | 7.4 | 1.7 | 2.9 | 4.50 | c) Heat 30 min. at 1600° F and oil quench | | | Ball Stud |
| 3. | a) 100 | — | — | — | — | a) Heat to 1600° F | 60 ($R_c$) | 42 ($R_c$) | AISI 12L14 |
| | b) 75.6 | 16.7 | 2.0 | 5.7 | 8.15 | b) Heat at 1600° F 12 min. | | | Steel |
| | c) 87.4 | 8.1 | 1.6 | 2.9 | 5.00 | c) Heat at 1600° F 40 min. and oil quench | | | Ball Stud |
| 4. | a) 100 | — | — | — | — | a) Heat to 1600° F + 20 min. | | | AISI 12L14 Steel |
| | b) 75.6 | 16.7 | 2.0 | 5.7 | 8.15 | b) Heat at 1600° F 12 min. | 60($R_c$) | 44($R_c$) | Ball Socket Body |
| | c) 87.4 | 8.1 | 1.6 | 2.9 | 5.00 | c) Heat at 1600° F 12 min. and oil quench | | | |
| 5. | a) 100 | — | — | — | — | a) Heat to 1600° F + 20 min. | | | |
| | b) 75.0 | 16.1 | 2.7 | 6.2 | 6.06 | b) Heat at 1600° F 12 min. | 60($R_c$) | 37($R_c$) | AISI 12L14 Steel |
| | c) 87.1 | 7.7 | 1.9 | 3.3 | 4.00 | c) Heat at 1600° F 8 min. and oil quench | | | Ball Socket Body |
| 6. | a) 100 | — | — | — | — | a) Heat to 1600° F + 20 min. | | | AISI 12L14 Steel |
| | b) 75.0 | 16.1 | 2.7 | 6.2 | 6.06 | b) Heat at 1600° F 12 min. | 61($R_c$) | 43($R_c$) | Ball Stud |
| | c) 87.1 | 7.7 | 1.9 | 3.3 | 4.00 | c) Heat at 1600° F 28 min. and oil quench | | | |
| 7. | a) 100 | — | — | — | — | a) Heat to 1650° F | | | AISI 8620 Steel |
| | b) 79.3 | 11.6 | 2.2 | 6.9 | 5.15 | b) Heat at 1650° F 60 min. | | | Air Motor Cylinder |
| | c) 79.7 | 11.1 | 2.9 | 6.3 | 3.74 | c) Heat at 16.50° F 180 min. | | | |
| | d) 87.1 | 7.3 | 2.4 | 3.2 | 3.00 | d) Heat at 1650° F 36 min. and oil quench | 57($R_c$) | 51($R_c$) | |

TABLE IX

CONTINUOUS CARBONITRIDING

| Test | Input Blend (Vol. %) $N_2$ | $CH_4$ | $CO_2$ | $NH_3$ | Input $CH_4/CO_2$ (ave.) | Thermal Treatment | Microscopic Exam Depth of Case | Depth of Martensite | Material Treated |
|---|---|---|---|---|---|---|---|---|---|
| 1. | 67.3 | 20.0 | 3.3 | 9.4 | 6.0 | Heat 1650° F - Oil Quench Parts in furnace 42 min. | 0.006 - 0.010" | 0.004" to 0.006" | 7/8" O.D. × 1/16" wall × 1-1/2" Long Bushings AISI 1010 Steel |
| 2. | 78.4 | 15.1 | 2.2 | 4.2 | 6.75 | Heat 1600° F - Oil Quench Parts in furnace 32 min. | 0.006" - 0.009" | 0.004" (ave.) | AISI 12L14 Steel Ball Joint Studs |
| 3. | 78.1 | 16.2 | 1.2 | 4.5 | 13.5 | Heat 1650° F - Oil Quench Parts in furnace 32 min. | * | * | AISI 1010 Steel Steering Wheel Lock Rings 4" D × 1/8" |
| 4. | 89.3 | 6.9 | 2.0 | 1.8 | 3.5 | Heat 1580° F - Oil Quench Parts in furnace 28 min. | ** | ** | Sintered-Iron(70° C) Powder Metal Rings 6-7/8" O.D. × 1/8" Long |
| 5. | 62.2 | 27.2 | 2.7 | 7.8 | 10.0 | Heat 1600° F - Water Quench Parts in furnace 30 min. | .005" - .006" | ** | 8-18 × 3/4" Flat Head Machine Screws AISI 1022 Steel |

*Test showed parts did not meet surface hardness spec. of $R_c$ 60 min.

**Parts were surface hardened to pass test of resisting penetration by a file hardened to $R_c$ 60.

Examination of the foregoing tables shows that effective carbonitriding of ferrous metal articles can be obtained when a gaseous mixture containing 62 to 90% by volume nitrogen, 6.0 to 27% by volume methane, 1.0 to 3.5% by volume carbon dioxide and 1.5 to 10% by volume ammonia is injected into the furnace at the proper time. Controlling the ratio of methane to carbon dioxide to be between 3.0 and 13.5 leads to effective uniform carbonitriding of ferrous metal articles.

It should be noted that carbonitriding is even more effectively carried out when the following procedures are followed:

1. Inert nitrogen is used during heatup and temperature equalization of the load.
2. Ammonia is added to the nitrogen/methane/carbon dioxide carburizing blend.
3. Higher methane, carbon dioxide, and ammonia flow rates are used during the first 12 minutes or for the mean retention time the atmosphere is in the furnace of the carbonitriding cycle to more quickly establish the desired concentration of reacting gases in the furnace.
4. Minor adjustments in ammonia flow rates are used to produce the desired hardness profiles and microscopic appearance of metal structure in the case of the carbonitrided part.

The unique properties of the gas blends according to the present invention are their ability to affect the carbon level and the surface of the steel part by: carburizing, carbon restoration, or carbonitriding to increase the surface carbon of a steel part; to maintain a given quantity of carbon in the surface of the steel part as in neutral hardening; or to remove carbon from the surface of the steel part as in decarburizing. In order to do this effectively and consistently, the carbon potential of the furnace atmosphere gases must be controlled within close limits during the process. This has been demonstrated to be possible in the nitrogen/methane/carbon monoxide blends and in the blends with ammonia by monitoring the ratio of methane to carbon dioxide ($CH_4/CO_2$). This is amply demonstrated by the data presented in Tables I through IX and FIGS. 3 to 7 of the drawing.

As compared to conventional endothermic generated atmosphere the blended atmosphere according to the invention is a significant advance in that it provides the following benefits:

1. Reduced Natural gas consumption — In order to generate 100 SCF of endothermic gas about 35 SCF of natural gas is required. In addition, in carburizing and carbonitriding applications, an additional quantity of natural gas is generally added directly to the furnace. This addition of "enriching gas" usually includes adding a quantity amounting to 5 to 10% of the total endothermic gas flow. Thus the total natural gas consumption for carburizing would be about 40 to 45 SCF per 100 SCF of atmospheric gas. The blends of the present invention require only 15 SCF of natural gas per 100 SCF of atmosphere for carburizing and as little as 2 SCF of natural gas for neutral hardening. Thus natural gas savings for atmosphere uses range from 60 to 90% depending upon the process.

2. Process flexibility and Reliability — The gas blending concept lends itself to an added dimension in flexibility. Gas compositions for a desired process are available instantaneously ranging from pure nitrogen for idling to a rich nitrogen-methane-carbon dioxide blend for carburizing. Moreover with pure hydrogen available to blend with the nitrogen a new series of blends for annealing and brazing applications can also be produced. Improved reliability stems from the overall simplicity of the system and the fact that the blend constituents are supplied from on-site storage tanks or pipeline. Thus the atmospheres can be supplied to the furnace continually even through power failures.

3. Product Quality — Visually, the parts processed in the nitrogen blends appear brighter and cleaner than those processed similarly in endothermic gas. In addition, the parts processed in the blends show an absence of "grain boundary oxides" which are often observed in parts heat treated in endothermic gas. Although only limited information is available on this phenomena there are indication that grain boundary oxides can adversely affect the fatigue life of gears, bearings, and other parts subjected to cylical high surface stresses. The ability of the nitrogen blends to inhibit formation of grain boundary oxides is believed to stem from the high purity especially in terms of low oxygen and water vapor content.

4. Reduce Flammability and Toxicity — Endothermic gas is normally composed of 40% hydrogen, 2% carbon monoxide and 40% nitrogen. The blends according to the invention show a substantial reduction of flammable hydrogen and toxic carbon monoxide. Actual percentages of these ingredients will depend upon the input blend and the furnace temperature. For example in the case of neutral hardening the blend can be adjusted to a non-flammable composition about the 92 to 95% by volume nitrogen level.

5. Adaptable to existing furnace — Minimal capital investment is required and maintenance is simplified because no generator is required.

6. Safer — With a blending panel and source of pure nitrogen, the furnace can be rapidly purged with an inert gas (nitrogen).

It is within the scope of the present invention to use gases that are unreactive with ferrous metals at elevated temperature in place of nitrogen such as argon, helium, and rare inert gases.

Having thus described my invention what is desired to be secured by letters patent of the United States is set forth in the appended claims.

I claim:

1. A gaseous mixture prepared at ambient temperature suitable for injecting into a ferrous metal treating furnace maintained at a temperature in excess of 1500° F wherein ferrous metal parts are heated in a furnace atmosphere created by the gas mixture injected into the furnace, the atmosphere being variable to perform a treatment selected from the group consisting of carburizing, decarburizing, neutral hardening and carbonitriding, said mixture consisting essentially of 62 to 98% by volume substantially pure nitrogen;

1.5 to 30% by volume natural gas being substantially methane;

0.2 to 15% by volume substantially pure carbon dioxide;

the natural gas and carbon dioxide being present in a ratio of 0.5 to 15.0 natural gas/carbon dioxide; and 0.0 to 10% by volume substantially pure ammonia.

2. A mixture according to claim 1 wherein the quantity of methane plus carbon dioxide is between 2 and 23% by volume of the mixture.

3. A mixture according to claim 1 suitable for carburizing ferrous metal articles heated to a temperature of between 1600° and 1750° F consisting essentially of 78.0 to 92.0% by volume nitrogen;

6.5 to 20.0% by volume methane;

1.4 to 14.0% by volume carbon dioxide; and wherein the methane/carbon dioxide ratio of the mixture is between 1.4 and 8.0.

4. A mixture according to claim 3 wherein the methane plus carbon dioxide is between 9.5 and 20% by volume.

5. A mixture according to claim 1 suitable for neutral hardening ferrous metal articles heated to a temperature between 1500° and 1650° F consisting essentially of:

91.0 to 98.0% by volume nitrogen;

1.5 to 7.5% by volume methane;

0.2 to 2.0% by volume carbon dioxide; and wherein the methane/carbon dioxide ratio of the mixture is between 1.7 and 9.0.

6. A mixture according to claim 5 wherein the methane plus carbon dioxide is between 2 and 9.0% by volume.

7. A mixture according to claim 1 suitable for decarburizing ferrous metal articles heated to a temperature in excess of 1550° F consisting essentially of:

82.0 to 90.0% by volume nitrogen;
3.3 to 15.0% by volume methane;
1.7 to 12.0% by volume carbon dioxide; and
wherein the ratio of methane to carbon dioxide in between 0.5 and 5.0.

8. A mixture according to claim 7 wherein the methane plus carbon dioxide is between 10 and 18% by volume of the mixture.

9. A mixture according to claim 1 suitable for carbonitriding ferrous metal articles heated to a temperature between 1550° and 1650° F consisting essentially of:

62.0 to 90% by volume nitrogen;
6.0 to 29.0% by volume methane;
1.0 to 3.5% by volume carbon dioxide;
1.5 to 10.0% by volume ammonia; and
wherein the ratio of methane to carbon dioxide is between 3.0 and 13.5.

10. A composition according to claim 9 wherein the methane plus carbon dioxide in between 9.6 and 30.0% by volume.

11. A method of heat treating ferrous articles in a furnace raised to an elevated temperature and under a furnace atmosphere that can be varied to be classified as carburizing, decarburizing, neutral or carbonitriding in character comprising the steps of:

a. charging the articles to be treated into a furnace maintained at a temperature in excess of 1500° F;
b. mixing outside the furnace at ambient temperature a gas composition consisting essentially of 65 to 98% by volume nitrogen, 1.5 to 30% by volume natural gas being substantially methane; 0.2 to 15% by volume substantially pure carbon dioxide, 0.0 to 10% by volume substantially pure ammonia, the natural gas and carbon dioxide being present in a ratio of 0.5 to 15.0 natural gas/carbon dioxide;
c. injecting said mixture into said furnace to form a furnace atmosphere as the articles are being heated;
d. maintaining said articles at a temperature in the presence of said furnace atmosphere until said parts are in thermal equilibrium with said furnace;
e. continuing said heating under atmosphere until said parts have been treated by said atmosphere according to the nature of the atmosphere present in said furance; and
f. cooling said articles to ambient temperature.

12. A method according to claim 11 wherein substantially pure nitrogen is injected into said furnace until said articles reach the temperature of the furnace.

13. A method according to claim 11 wherein the ratio of methane to carbon dioxide in the mixture injected into the furnace is between 1.2 and 15.0.

14. A method according to claim 11 wherein the articles are subjected to a carburizing treatment by maintaining the furnace at a temperature of between 1650° and 1750° F and injecting an atmosphere into the furnace consisting essentially of 80 to 90% by volume nitrogen balance, a mixture of methane, plus carbon dioxide wherein the ratio of methane to carbon dioxide is between 1.4 and 8.0.

15. A method according to claim 11 wherein the articles are subjected to a neutral hardening treatment by maintaining the furnace at a temperature between 1500° and 1650° F and injecting an atmosphere into the furnace consisting essentially of 91 to 98% by volume nitrogen balance a mixture of methane and carbon dioxide wherein the ratio of methane to carbon dioxide is between 1.7 and 9.0.

16. A method according to claim 11 wherein the articles are subjected to a decarburizing treatment by maintaining the furnace at a temperature between 1550° and 1750° F and injecting into the furnace an atmosphere consisting essentially of 82 to 90% by volume nitrogen, balance a mixture of methane and carbon dioxide wherein the ratio of methane to carbon dioxide is between 0.5 and 5.0.

17. A method according to claim 11 wherein the articles are subjected to a carbonitriding treatment by maintaining the furnace at a temperature of between 1550° and 1650° F and injecting into the furnace an atmosphere consisting essentially of 62 to 90% by volume nitrogen, 1.5 to 10.0% by volume ammonia, balance methane plus carbon dioxide present in a ratio of methane to carbon dioxide of between 3.0 and 13.5.

18. A method according to claim 17 wherein the articles being treated are brought to the temperature of the furnace under an atmosphere of substantially nitrogen gas and then heated under the carbonitriding atmosphere at temperature.

19. A method according to claim 11 wherein a gas selected from the group consisting of argon, helium and rare inert gases is substituted for the nitrogen.

* * * * *